United States Patent [19]

Gardner

[11] Patent Number: 4,652,307

[45] **Date of Patent: * Mar. 24, 1987**

[54] REFINING AND/OR ALLOYING OF A 3 PERCENT TO 6 PERCENT CARBON IRON, COBALT, OR NICKEL ON A MOLTEN SILVER SURFACE AT TEMPERATURES 1000° C. TO 1525° C. PRODUCING AN IRON COBALT OR NICKEL POWDER, OR THEIR ALLOYS AND A PETROLEUM PRODUCT

[76] Inventor: Herman Gardner, 23471 Sussex, Oak Park, Mich. 48237

[ * ] Notice: The portion of the term of this patent subsequent to Sep. 9, 2000 has been disclaimed.

[21] Appl. No.: 590,155

[22] Filed: Mar. 16, 1984

[51] Int. Cl.[4] ..... C21B 15/00

[52] U.S. Cl. ..... 75/37; 75/45; 75/53; 75/0.5 R; 75/0.5 BA; 75/82; 206/8

[58] Field of Search ..... 75/83, 82, 29, 33, 45, 75/53, 57, 36, 37, 0.5 B, 0.5 BA; 206/8 R; 420/590

[56] References Cited

U.S. PATENT DOCUMENTS 4,406,695 9/1983 Gardner ..... 75/37

*Primary Examiner*—Christopher W. Brody

[57] ABSTRACT

An iron containing 3% to 6% carbon and small quantities of manganese, silicon, sulfur and phosphorus produced by the blast furnace, electric furnace, or other well-known furnace requires a relatively low temperature to convert to the molten state. This molten iron can be refined on the surface of molten silver at temperatures from 1000° C. to 1525° C. containing on the surface of the molten metal an oxide of lead or oxides of nickel, cobalt, iron, manganese, copper, zinc, and other metals whose oxides are reducible to the elemental state by carbon resulting in a refined or alloyed steel. The carbon monoxide formed in this reaction may be combined with hydrogen at temperatures from 400° C. to 1000° C. and 100 atmospheres to 150 atmospheres in the presence of a proper catalyst according to the known Fischer-Tropsch reaction to form a petroleum product. Alternately a finely ground iron containing 3% carbon to 6% carbon can be furnaced at 1000° C. to 1525° C. to produce either iron powder to fabricate iron powder parts or a steel billet to make steels of any shape or form with rolling equipment. Also the carbides of nickel, cobalt, and other elements can be converted to the elemental state by reaction with an oxide on the surface of the molten metal.

8 Claims, No Drawings

REFINING AND/OR ALLOYING OF A 3 PERCENT TO 6 PERCENT CARBON IRON, COBALT, OR NICKEL ON A MOLTEN SILVER SURFACE AT TEMPERATURES 1000° C. TO 1525° C. PRODUCING AN IRON COBALT OR NICKEL POWDER, OR THEIR ALLOYS AND A PETROLEUM PRODUCT

This invention relates to the use of molten silver on whose surface a large number of chemical reactions occur at temperatures from 1000° C. to 1525° C.

The object of the invention is to provide an alternate method for the manufacture of steel alloys of varying composition and iron powder on a molten metal surface forming carbon monoxide which combines with hydrogen to form a petroleum product by the known Fischer-Tropsch process.

Another object of this invention is to reduce an oxide of a reducible metal on the surface of the same molten metal with varying forms of carbon to produce increasing amounts of the reducible metal and carbon monoxide.

An advantage of this invention in the processing of steel is the substantial lower temperature required to melt a 4% to 6% carbon iron. Also all by-products of these reactions are used.

The following information is taken mostly from the text: Hansen, Max, 'Constitution of Binary Alloys', 2nd edition, McGraw-Hill, 1958.

These elements do not alloy with iron and have these properties:

| Element | Melting Point °C. | Boiling Point °C. | Density g/cm$^3$ |
|---|---|---|---|
| Lithium | 180.54 | 1317 | 0.534 |
| Sodium | 97.8 | 883 | 0.97 |
| Potassium | 63.6 | 774 | 0.86 |
| Rubidium | 38.9 | 688 | 1.532 |
| Cesium | 28.4 | 678 | 1.88 |
| Magnesium | 649 | 1107 | 1.74 |
| Calcium | 839 | 1484 | 1.54 |
| Strontium | 769 | 1384 | 2.6 |
| Barium | 725 | 1640 | 3.51 |
| Silver | 962 | 2212 | 10.5 |
| Cadmium | 321 | 765 | 8.642 |
| Mercury | −38.9 | 356.6 | 13.59 |
| Thallium | 303.5 | 1457 | 11.85 |
| Lead | 327.5 | 1740 | 11.3 |
| Bismuth | 271.3 | 1560 | 9.8 |

Iron has a melting point of 1535° C. and a boiling point of 2750° C. with a density of 7.86 g/cm$^3$. Since we wish to reach about 1500° C., barium, silver, lead and bismuth can be considered. We eliminate barium since its density is too low. Therefore the molten medium on which the reaction $2C+O_2=2CO$ can occur includes lead, silver, and bismuth. Because silver has the highest melting point and the highest boiling point, silver is the element of choice.

Further, these facts can be taken from the above text: Iron and lead are completely insoluble both in the solid state and the liquid state. Iron and silver are completely insoluble both in the solid state and the liquid state. Cobalt and silver are virtually insoluble both in the solid state and the liquid state. Similarly nickel and silver are virtually insoluble in each other both in the solid state and the liquid state. The compound $Co_2C$ forms at a composition of 9.25% carbon. Also the compound $Co_3C$ forms at 6.30% carbon. Nickel carbide $Ni_3C$ forms at a composition of 6.39% carbon. Iron carbide $Fe_3C$ forms at a composition of 6.67% carbon.

Many oxides are readily reduced with carbon at high temperatures.

Basically steel is produced by reducing iron oxide ore with coke in a blast furnace and refining this molten product by the basic oxygen process. Continuous casting and rolling results in a final steel product. In these refining processes the carbon ends ultimately as carbon dioxide $CO_2$ vented into the air.

In this invention the molten iron from the blast furnace is produced with carbon as the only impurity and the other impurity elements, manganese, silicon, sulfur, and phosphorus, in low percentages or electric melting of scrap steel with coke, broken electrodes, graphite, or any other carbon source, resulting in a 4% to 6% carbon iron, is the raw material. When the molten iron is poured on the molten metal containing oxygen, a chemical reaction occurs according to this equation:

$$Fe(C)+\text{Metal Oxide}(O)=CO+Fe+\text{Metal}$$

The oxygen is obtained in a number of ways:

Iron oxide is added to the surface of the metal.

Molten metal is oxidized with pure oxygen, oxygen in air, steam $H_2O$, or carbon dioxide $CO_2$.

Other oxides like nickel oxide, cobalt oxide, manganese oxide, etc. is/are applied to the surface of the molten metal resulting in alloying of the steel with these elements.

Alternately these oxides may be mixed with a ground iron containing 4% to 6% carbon, applied to the molten metal surface forming an iron powder or a solid cake for rolling.

Cobalt based alloys are produced by melting cobalt metal with from 4% to 6% carbon, shotting the molten product and furnacing the ground product mixed with oxides of copper, manganese, nickel, iron, or other reducible oxides at temperatures 1000° C. to 1500° C. on molten silver. This reaction occurs:

$$Co(C)+FeO=CO+CoFe$$

Approximately 20% of iron can be alloyed with 80% of cobalt. If the carbon content of the cobalt is raised the amount of alloying of either iron or any other reducible element is increased. The carbon content in the cobalt can be controlled to any desired level below 1% by controlling the quantity of reducible oxide added to the shotted product.

Nickel based alloys are produced by melting nickel metal with 4% to 6% carbon, shotting the molten product and furnacing the ground product mixed with oxides of copper, manganese, cobalt, iron, or other reducible oxides at temperatures 1000° C. to 1500° C. on molten silver. This reaction occurs:

$$Ni(C)+FeO=CO+NiFe$$

Approximately 21% of iron can be alloyed with 80% of nickel. The carbon content in the nickel can be controlled to any desired level below 1% by controlling the quantity of reducible oxide added to the ground product.

A unique product is formed by furnacing at temperatures 1100° C. to 1500° C., ⅛ to ¾ inch ground mix on 1/64 to ½ inch thick steel plate (or alloy steel plate, stainless steel plate, nickel plate, or any high melting point metal plate) producing a metallurgical bond between the porous structure of the ground shot and the solid steel plate. This clad product consists of a porous structure metallurgically bonded to a steel backing or to any alloy backing. The clad product can be rolled to any desired commercial cross section. These variables can be controlled:

1. Size of the particles of the porous structure
2. Shape of the particles of the porous structure
3. Hardness of the particles of the porous structure
4. Thickness of the porous structure and the backing
5. Chemistry of the porous structure and the backing This unique clad product leads to a number of desirable applications. The porous structure is an admirable surface for catalytic reactions. Catalytic reaction chambers can be welded together with the clad product with the catalyst facing the interior of the chamber. These chambers can be of any desired configuration.

The addition of platinum in either the molten shot or the oxide of the porous structure of the clad product results in the manufacture of a car muffler which acts as a catalytic converter as well as a muffler.

Liners for cylinders of diesel engines may use this unique clad product as the property of the porous structure can be changed to the optimum property for this application. The possibility of designing a suitable seal for Wankel engines exists for this clad product as the optimum property may be produced by varying the hardness, porosity, and alloying content of the porous structure as well as the chemistry of the backing.

These applications are examples where the clad product may be advantageously used. Many more applications may come to mind for the knowing reader.

In all of the possible reactions at the higher temperatures carbon monoxide is formed which combined with hydrogen reacts to a petroleum product by the Fischer-Tropsch reaction. The hydrogen is obtained from an outside source or from the reaction of steam on metal.

The Fischer-Tropsch reaction combines hydrogen and carbon monoxide at temperatures of 400° C. to 500° C., at pressures of 100 atmospheres to 150 atmospheres in the presence of a catalyst to form a petroleum like product:

$$13H_2+6CO=C_6H_{14}+6H_2O$$

If 100 grams molten iron containing 4% carbon reacts completely with excess oxygen on the molten metal surface, 96 grams of pure iron and 10 grams of carbon monoxide yields ideally 5 grams of $C_6H_{14}$. Thus a million metric tons of steel extrapolates to 52,000 metric tons of $C_6H_{14}$.

The advantage of this process is that no heat is required to produce the petroleum like product by the Fischer-Tropsch process.

What is claimed is:

1. A process for producing a carbon containing iron powder comprising furnacing a mixture comprising of at least 77% of a ground iron powder containing 3% to 6% carbon and the balance being an oxygen bearing iron powder material on a molten silver bath at 1100° C. to 1200° C. producing carbon monoxide as a by-product of the furnacing step and converting said carbon monoxide to a petroleum product using hydrogen in a Fischer-Tropsch reaction.

2. The process according to claim 1 comprising the step of adding lead oxide to the surface of the molten silver bath prior to the furnacing step.

3. A process for producing an alloy steel powder, comprising furnacing a ground iron powder containing 3% to 6% carbon on a molten silver bath, which has a metallic oxide selected from the group consisting of NiI, MnO, CoO and CuO on the bath surface, at 1100° C. to 1200° C., producing carbon monoxide as a by-product of the furnacing step, and converting said carbon monoxide to a petroleum product using hydrogen in a Fischer-Tropsch reaction.

4. A process for producing an alloy steel powder comprising furnacing a mixture containing at least 77% ground iron powder containing 3% to 6% carbon and the balance being metallic oxides selected from the group consisting of NiO, MnO, CoO and CuO on a molten bath of silver at 1100° C. to 1200° C., producing carbon monoxide as a by-product of the furnacing step and converting said carbon monoxide to a petroleum product using hydrogen in a Fischer-Tropsch reaction.

5. A process for producing an alloy steel product comprising furnacing at 1200° C. to 1500° C. a mixture containing 3% to 6% carbon and a metal oxide selected from the group consisting of FeO, NiO, MnO, CoO, and CuO on a molten silver bath, forming a steel structure and processing said steel structure by rolling, producing carbon monoxide as a by product of the furnace step, and converting said carbon monoxide to a petroleum product using hydrogen in a Fischer-Tropsch reaction.

6. A process for producing an alloy steel comprising furnacing a molten iron containing 3% to 6% carbon on a molten silver bath, said molten silver bath having a metal oxide selected from the group consisting of FeO, NiO, MnO, CoO, and CuO on the bath surface, forming a steel structure from the molten iron and metal oxide, processing the steel structure by rolling, producing carbon monoxide as a by-product from the turning step and converting said carbon monoxide to a petroleum product using hydrogen in a Fischer-Tropsch reaction.

7. A process for producing a cobalt based alloy product, comprising, furnacing at 1200° C. to 1500° C. a mixture comprising a ground cobalt containing 4% to 6% carbon and a metal oxide selected from the group consisting of FeO, NiO, MnO, CoO and CuO on a metal silver bath, forming a structure on said bath, processing said structure by rolling, producing carbon monoxide as a by-product of the furnacing step, and converting said carbon monoxide to a petroleum product using hydrogen in the Fischer-Tropsch reaction.

8. A process for producing a nickel based alloy comprising, furnacing at 1200° C. to 1400° C. a mixture comprising a ground nickel containing 4% to 6% carbon and a metal oxide selected from the group consisting of FeO, NiO, MnO, CoO, and CuO on a molten silver bath, producing carbon monoxide as a by-product of the furnacing step, and converting said carbon monoxide to a petroleum product using hydrogen in a Fischer-Tropsch reaction.

* * * * *